US007896462B2

(12) United States Patent
Furukawa

(10) Patent No.: US 7,896,462 B2
(45) Date of Patent: Mar. 1, 2011

(54) CLEANING METHOD AND CLEANING UNIT OF INK EJECTION SECTION, AND IMAGE FORMING APPARATUS

(75) Inventor: Noriaki Furukawa, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 171 days.

(21) Appl. No.: 12/379,496

(22) Filed: Feb. 24, 2009

(65) Prior Publication Data

US 2009/0219335 A1 Sep. 3, 2009

(30) Foreign Application Priority Data

Feb. 25, 2008 (JP) ..... 2008-042635

(51) Int. Cl.
*B41J 2/165* (2006.01)

(52) U.S. Cl. ..... 347/33; 347/28; 347/32

(58) Field of Classification Search ..... 347/33, 347/28, 32, 29

See application file for complete search history.

(56) References Cited

U.S. PATENT DOCUMENTS 6,460,967 B1 * 10/2002 Makita et al. ..... 347/33

FOREIGN PATENT DOCUMENTS

EP 1 405 725 * 4/2004
JP 2002-361879 12/2002

* cited by examiner

*Primary Examiner*—Shih-Wen Hsieh
(74) *Attorney, Agent, or Firm*—Clark & Brody

(57) ABSTRACT

A method of cleaning an ink ejection section in an image forming apparatus that forms an image by ejecting an ink from the ink ejection section. The method includes the steps of: an ink wiping step for wiping off the ink on the surface of the ink ejection section; a first cleaning step for cleaning the surface of the ink ejection section with a water-soluble organic solvent; a second cleaning step for cleaning with water the surface of the ink ejection section cleaned with the water-soluble organic solvent; and a liquid wiping step for wiping off the liquid on the surface of the ink ejection section cleaned through the second cleaning step.

15 Claims, 7 Drawing Sheets

CLEANING METHOD AND CLEANING UNIT OF INK EJECTION SECTION, AND IMAGE FORMING APPARATUS

Priority is claimed to Japanese Patent Application No. 2008-042635 filed on Feb. 25, 2008, the disclosure of which is incorporated by reference in its entirety.

BACKGROUND OF THE INVENTION

1. Field of the Invention

The present invention relates to a cleaning method and a cleaning unit of an ink ejection section in an image forming apparatus such as an inkjet color printer, and to an image forming apparatus.

2. Description of Related Art

In image forming apparatuses, there are apparatuses of the type which forms an image on a paper by ejecting an ink onto a paper as a recording medium, such as inkjet color printers. These image forming apparatuses are provided with an image formation section capable of forming an image, a paper storage section to store a paper whose surface is used for image formation, a paper transport section to transport a paper to the image formation section, and a paper discharge section capable of discharging a paper with an image formed on the surface thereof. In these image forming apparatuses, the paper stored in the paper storage section is transported to the image formation section by the paper transport section, and the image based on image information is formed on the paper. The paper after being subjected to the image formation by the image formation section is then discharged into the paper discharge section.

Specifically, the image formation section has an ink ejection section capable of ejecting an ink onto a paper, and a cleaning unit to clean the ink ejection section as shown in, for example, Japanese Unexamined Patent Application Publication No. 2002-361879. During an image forming operation, the ink is ejected onto a paper from the ink ejection section, and the ink ejection section is cleaned by the cleaning unit. This cleaning unit is provided with a cleaning blade formed by an elastic material, and a wet porous elastic body.

In the cleaning unit as described above, after the ink of the ink ejection section is absorbed by the porous elastic body, the surface of the ink ejection section is wiped off by the cleaning blade, that is, the moisture and the like at the ink ejection section are wiped off. However, if the ink cannot be completely absorbed by the porous elastic body, cleaning efficiency becomes poor, and the water repellency of the ink ejection section is deteriorated by the adhered and dried ink at the ink ejection section. Thus, the deteriorated water repellency of the ink ejection section leads to deterioration of image quality.

Also in a state in which the resin composition contained in the ink is adhered to the ink ejection section, image quality might also be deteriorated by the difficulty in controlling the ink ejection. Particularly in an elongated line head, because the amount of ink adhesion is larger than that of a serial head, there is a large possibility that image quality may be deteriorated due to insufficient ink removal. That is, the ink adheres to the ink ejection section and then dries there, so that the resin composition is solidified around an ink ejection hole provided at the ink ejection section. When the ink is ejected in this state, for example, the solidified resin composition and the ejected ink contact with each other, and the normal ink ejection may be hindered to cause image quality deterioration.

SUMMARY OF THE INVENTION

An advantage of the present invention is to provide a cleaning method and a cleaning unit of an ink ejection section, and an image forming apparatus which are capable of efficiently removing the ink adhered to the ink ejection section and improving poor ink ejection.

The present invention is a method of cleaning an ink ejection section in an image forming apparatus that forms an image by ejecting an ink from the ink ejection section. The method includes an ink wiping step for wiping off the ink on the surface of the ink ejection section, a first cleaning step for cleaning the surface of the ink ejection section with a water-soluble organic solvent, a second cleaning step for cleaning with water the surface of the ink ejection section cleaned with the water-soluble organic solvent, and a liquid wiping step for wiping off the liquid on the surface of the ink ejection section cleaned through the second cleaning step.

Preferably, the water-soluble organic solvent has a solubility parameter (SP value) of 7 to 14. The term "solubility parameter" (unit: $(cal/cm^3)^{1/2}$) is a numerical value indicating the polarity of a material. A smaller SP value difference between a solute and a solvent produces a larger solubility.

According to the present invention, the ink solidified at the ink ejection section can be efficiently removed to enable improvement of poor ink ejection by wiping off the ink on the surface of the ink ejection section before the cleaning step, and further cleaning the surface of the ink ejection section with the water-soluble organic solvent. Additionally, the water repellency of the surface of the ink ejection section can be recovered to reduce image quality deterioration by cleaning and removing with water the water-soluble organic solvent remaining on the surface of the ink ejection section.

A cleaning unit of the present invention suitable for practicing the above cleaning method is shiftably mounted in an image forming apparatus provided with an ink ejection section having an ink ejection surface capable of ejecting an ink. The cleaning unit includes a first blade member for wiping off an ink contactable with the ink ejection surface, a first porous member impregnated with a water-soluble organic solvent, a second porous member impregnated with water, and a second blade member for wiping off liquid contactable with the ink ejection surface. The first blade member, the first porous member, the second porous member and the second blade member are arranged in the order named along the shift direction of the cleaning unit.

An image forming apparatus of the invention includes at least an image formation section provided with an ink ejection section having an ink ejection surface capable of ejecting an ink, and further includes the above cleaning unit.

DESCRIPTION OF PREFERRED EMBODIMENTS

First Preferred Embodiment

<Image Forming Apparatus>

Figure 1:
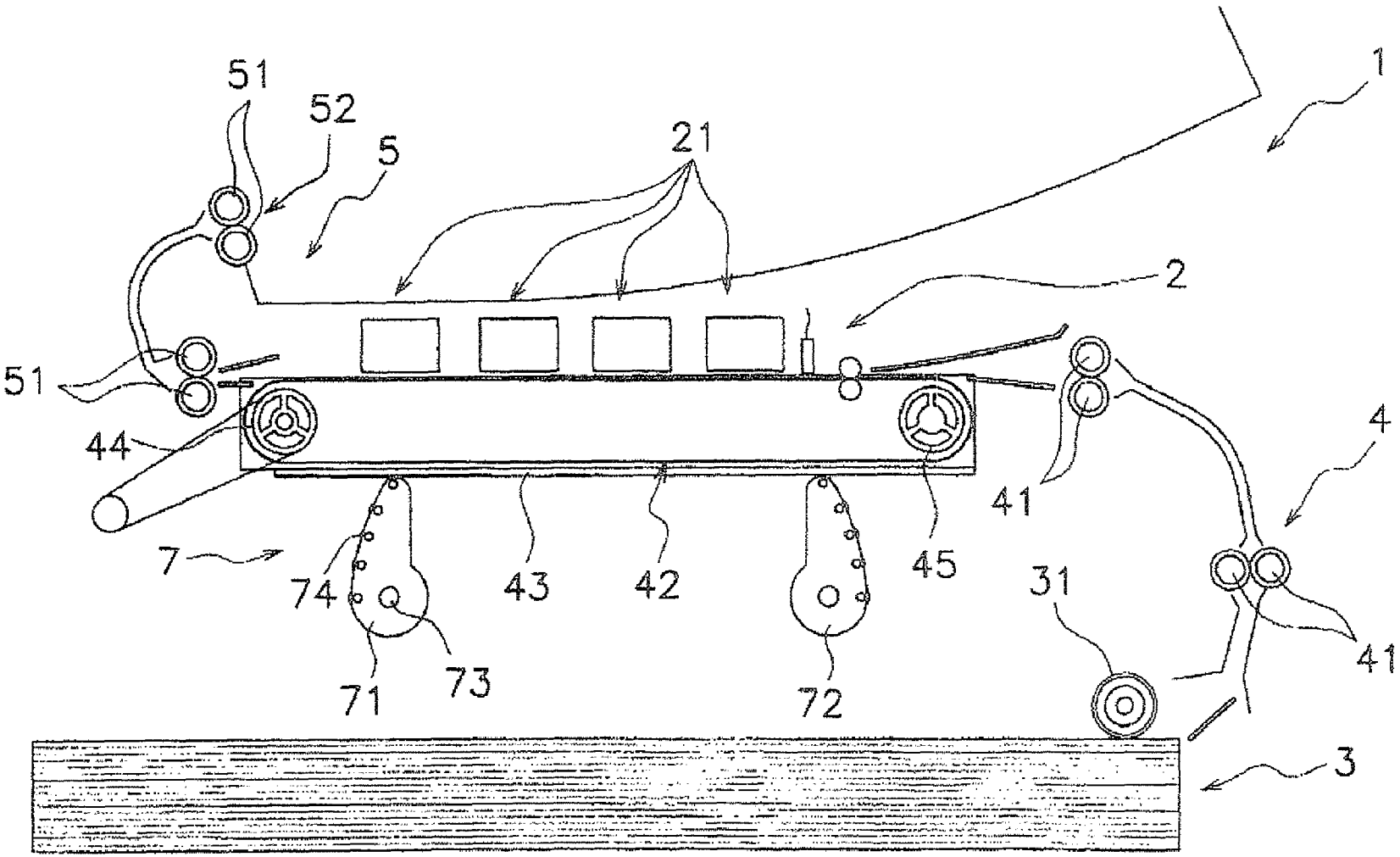
FIG. 1 is a schematic front view of an image forming apparatus according to the invention.

An inkjet printer 1 as an image forming apparatus according to the invention is shown in FIG. 1. FIG. 1 is a schematic front view schematically showing the configuration of the inkjet printer 1. The inkjet printer 1 is an apparatus which is connected to an external computer or the like (not shown), and capable of forming an image based on image information transmitted from the computer, and which is provided with an image formation section 2, a paper storage section 3, a paper transport section 4, a lift unit 7 and a paper discharge section 5.

The image formation section 2 forms an image based on image information, and has inkjet heads 21. That is, the four inkjet heads 21 are arranged side by side above a later-described transport belt 42 of the paper transport section 4, and they eject inks onto a paper based on the image information. These inkjet heads 21 store different color inks and have ink ejection sections 211 (refer to FIG. 3) capable of ejecting the inks stored therein, respectively. These inkjet heads 21 are substantially rectangular parallelepiped-shaped members extending in one direction (a direction orthogonal to the paper surface in FIG. 1). Each of these ink ejection sections 211 has an ink ejection surface 212 (refer to FIG. 3) arranged oppositely to the paper, and is provided with a plurality of ink ejection holes arranged side by side. The ink ejection surface 212 has a rectangular shape extending long in the back-and-forth direction. The term "back-and-forth direction" means a direction perpendicular to the paper surface in FIG. 1, and the near side and the rear side in the direction perpendicular to the paper surface in FIG. 1 are referred to as "the front" and "the rear," respectively.

The paper storage section 3 is capable of storing papers for image formation and arranged at a lower part of the inkjet printer 1. The paper storage section 3 has a paper supply roller 31 for supplying papers to the paper transport section 4, above the tip end on the paper supply side.

The paper transport section 4 transports the paper in the paper storage section 3 to the image formation section 2, and also transports the paper with an image formed on the surface thereof to the discharge section 5. The paper transport section 4 is provided with a plurality of rollers 41 for transporting a paper, and the transport belt 42. The transport belt 42 is an endless belt underlying the inkjet heads 21, and has on both ends thereof rollers 44 and 45 for circulating the transport belt 42.

The lift unit 7 underlies the transport belt 42 of the paper transport section 4 and vertically lifts the transport belt 42. The lift unit 7 has a pair of eccentric cams 71 and 72. Specifically, the first eccentric cam 71 positioned leftward in FIG. 1 is provided rotatably around a shaft 73, and rotationally driven by a motor (not shown). The first eccentric cam 71 is provided with a plurality of bearings 74, and supports a belt support member 43 through these bearings 74. In FIG. 1, the reference numeral is applied only one of these bearings 74, with others omitted. The second eccentric cam 72 positioned rightward in FIG. 1 has the same structure as the first eccentric cam 71, and has a symmetrical shape with respect to the first eccentric cam 71 in the left-to-right direction in FIG. 6.

Figure 2:
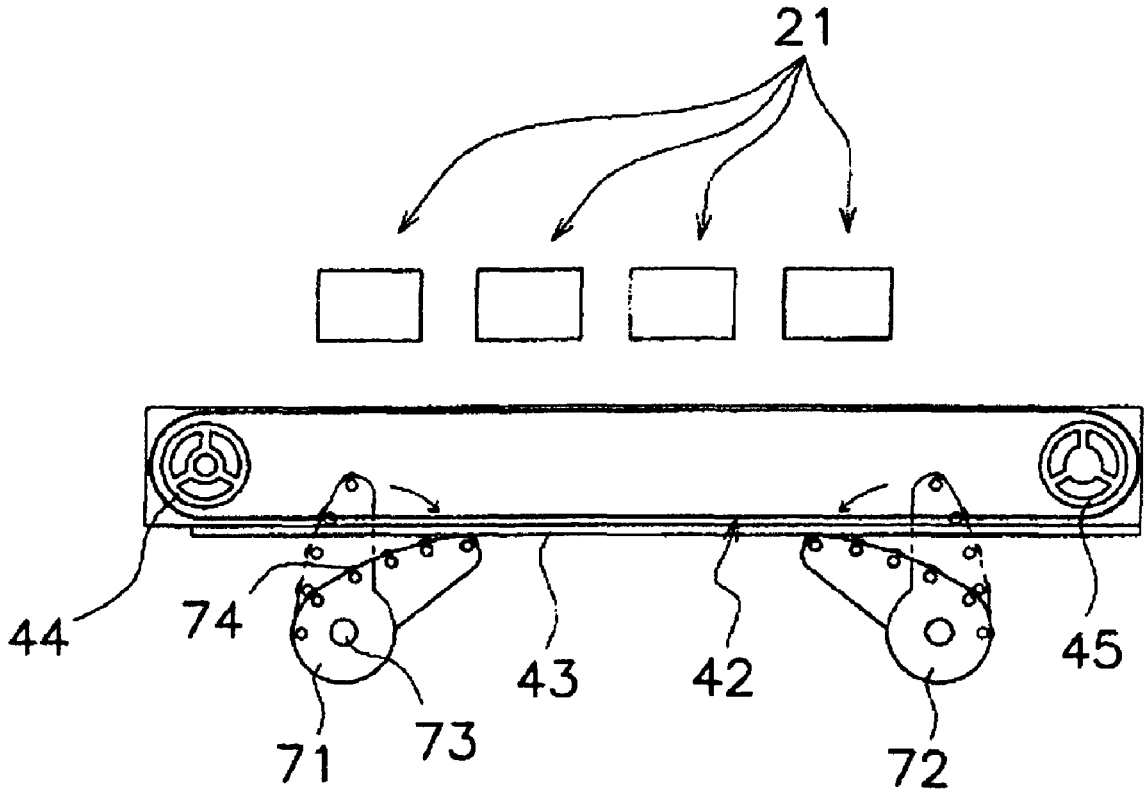
FIG. 2 is an explanatory drawing showing the up and down movement of a transport belt by a lift unit.

FIG. 1 shows the state in which the transport belt 42 is ascended. From this state, the transport belt 42 is descended by the inward rotation of the pair of the eccentric cams 71 and 72 (refer to FIG. 2). When the image formation section 2 forms an image on a paper, the lift unit 7 provides a suitable space for printing (approximately 1 mm in the present preferred embodiment) between the inkjet heads 21 and the paper by bringing the transport belt 42 into the ascent state shown in FIG. 1. When removing a jam occurred on the transport belt 42, and when later-described cleaning units 22 clean the inkjet heads 21, the lift unit 7 provides a wide space between the inkjet heads 21 and the paper by bringing the transport belt 42 into the descent state shown in FIG. 2.

The discharge section 5 discharges the paper with the image formed thereon by the image formation section 2, and is arranged at the upper part of the inkjet printer 1. The discharge section 5 is provided with a plurality of rollers 51. The paper with the image formed thereon by the image formation section 2 is transported by the transport belt 42 of the paper transport section 4 and these rollers 51 of the discharge section 5, and then discharged outside of the apparatus from a discharge port 52.

<Cleaning Unit Configuration>

Figure 3:
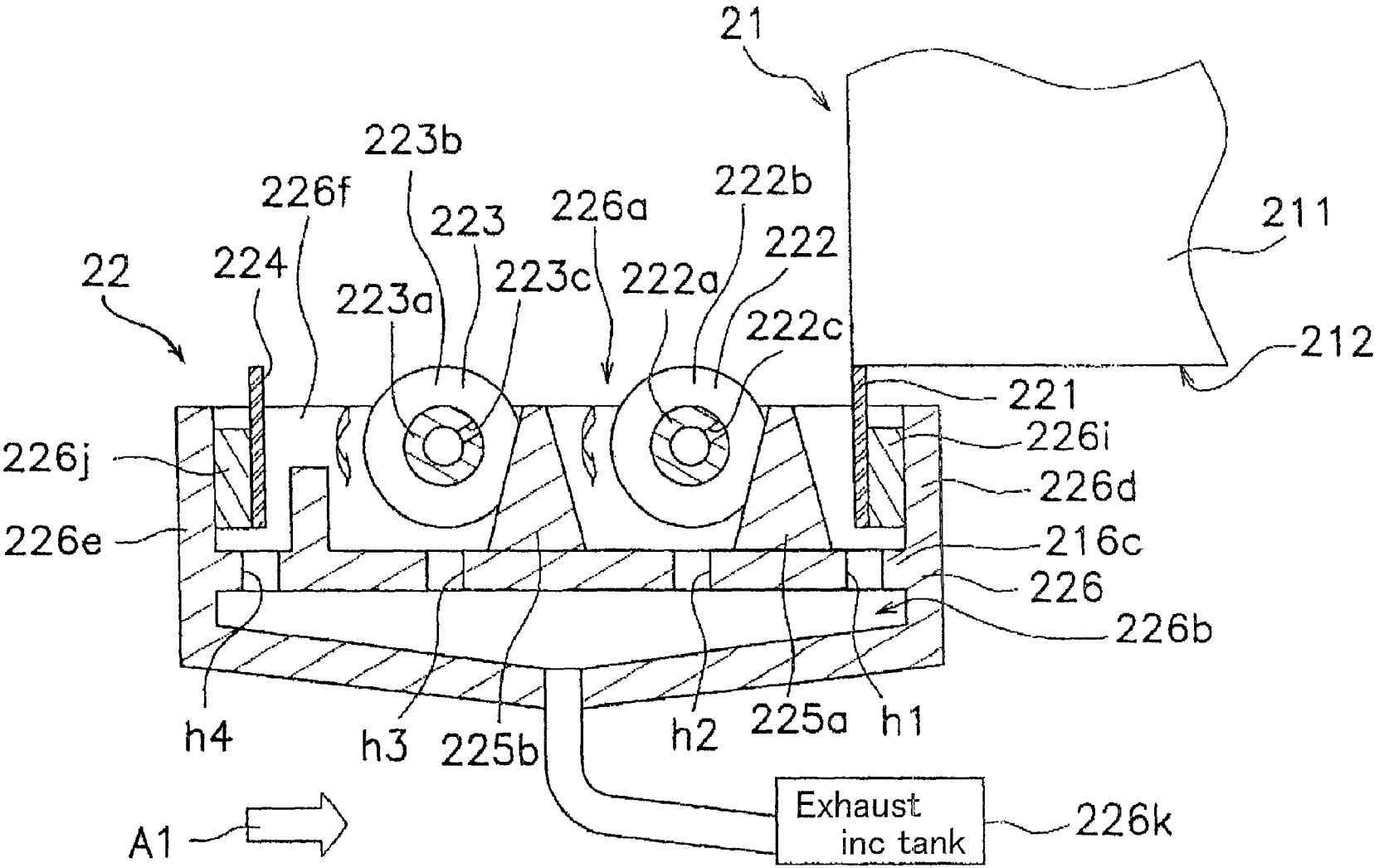
FIG. 3 is a sectional view of a cleaning unit according to a first preferred embodiment of the invention.
Figure 4:
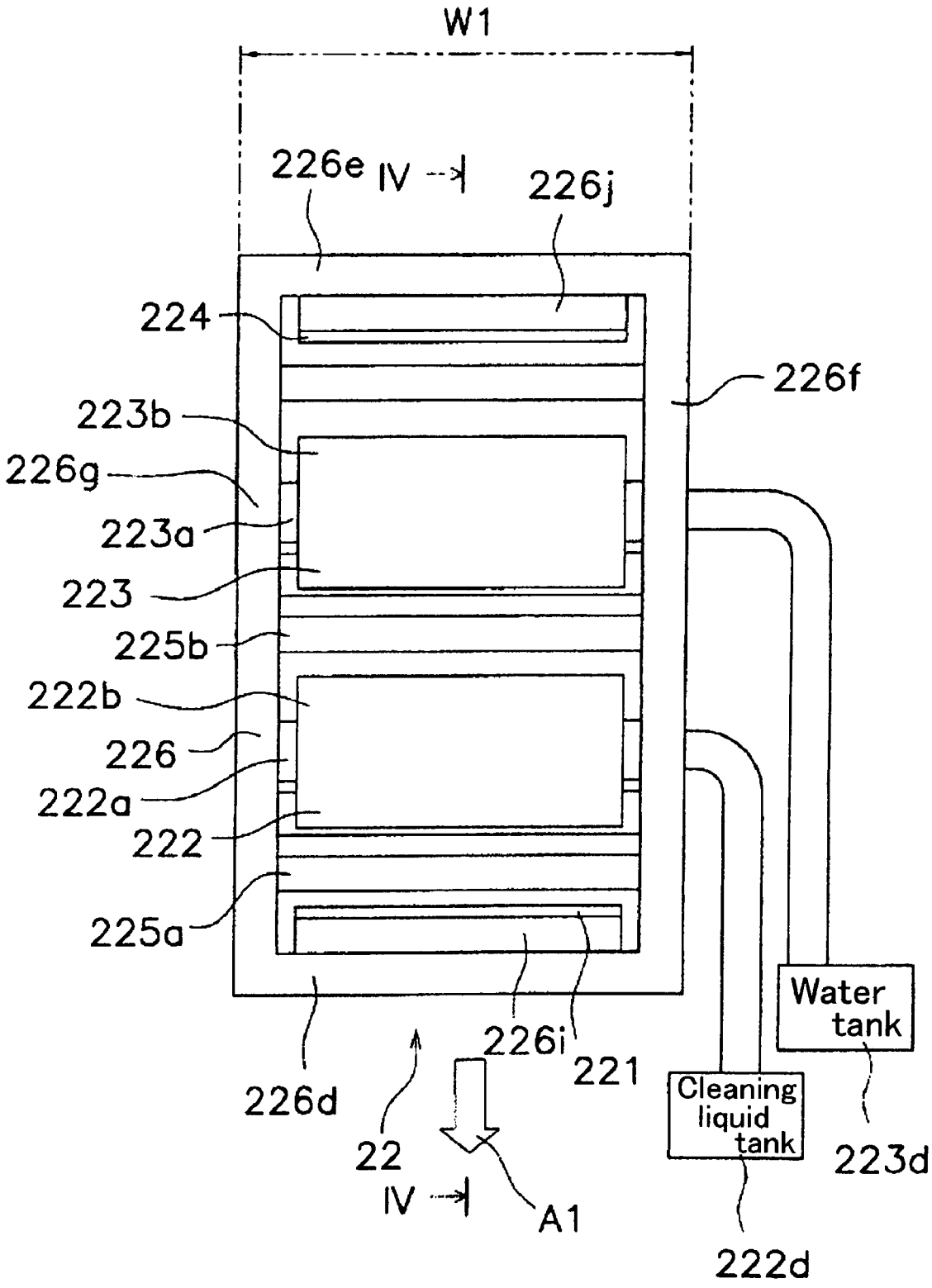
FIG. 4 is a plan view of the cleaning unit in FIG. 3.

FIGS. 3 and 4 are the overall schematic diagrams of the cleaning unit 22. FIG. 3 is a sectional view of the cleaning unit 22, and FIG. 4 is a plan view thereof. The cleaning units 22 for cleaning the ink ejection surfaces 212 are shiftable in the longitudinal direction of the inkjet heads 21 (refer to an arrow A1 in FIGS. 3 and 5). During image formation, the cleaning units 22 are retreated outside of the longitudinal ends of the inkjet heads 21, so as not to hinder the ink ejection. These cleaning units 22 are provided correspondingly to the individual inkjet heads 21, and are connected to an exhaust ink tank 226*k*. Each of these cleaning units 22 has a casing 226 provided with a first blade member 221, a cleaning liquid roller 222, a water roller 223, a second blade member 224 and restriction plates 225*a* and 225*b*, each of which is shifted in the direction of the arrow A1 along the ink ejection surface 212 by a shift mechanism 8 shown in FIG. 5.

The first blade member 221 wipes off the ink on the ink ejection surface 212, which is a plate-shaped member extending in one direction (a direction orthogonal to the paper surface in FIG. 3, namely, the transverse direction of the ink ejection surface 212). The length of the first blade member 221 in the direction orthogonal to the paper surface in FIG. 3 is substantially the same as the transverse length of the ink ejection surface 212. The first blade member 221 is arranged on the tip end in the shift direction of the casing 226, and the upper tip end thereof is arranged at a slightly higher position than the ink ejection surface 212. The first blade member 221 is formed by an elastic deformable material, such as EPDM or fluoro rubber, and arranged along the transverse direction of the ink ejection surface 212.

The cleaning liquid roller 222 cleans the ink ejection surface 212 with a water-soluble organic solvent described later, which is arranged adjacent to the first blade member 221, namely, arranged next to the first blade member 221 in the shift direction of the cashing 226. The length of the cleaning liquid roller 222 in the direction orthogonal to the paper surface in FIG. 3 (namely in the axial direction of the roller 222) is substantially the same as the transverse length of the ink ejection surface 212. The cleaning liquid roller 222 also has a cleaning liquid roller rotary shaft 222*a* and a first porous member 222*b*. The cleaning liquid roller rotary shaft 222*a* is a cylindrical hollow shaft member and extends in a direction orthogonal to the paper surface in FIG. 1. The cleaning liquid roller rotary shaft 222*a* is capable of containing therein the water-soluble organic solvent, and connected to a cleaning liquid tank 222*d* containing the water-soluble organic solvent. The cleaning liquid roller rotary shaft 222*a* also has an axially extending cleaning liquid admitting slit 222*c* (except for both ends of the rotary shaft), enabling the cleaning liquid therein to be supplied to the first porous member 222*b*. Instead of the cleaning liquid admitting slit 222*c*, a plurality of fine holes may be provided at the cleaning liquid roller rotary shaft 222*a*. The cleaning liquid roller rotary shaft 222*a* is fixed to the casing 226. The first porous member 222*b* is a porous member, such as a sponge, arranged around the cleaning liquid roller rotary shaft 222*a*. The first porous member 222*b* is arranged so that the uppermost position in the height position thereof is substantially the same as the height position of the tip end of the first blade member 221. The first porous member 222*b* is rotatable with respect to the cleaning liquid roller rotary shaft 222*a*, and rotates counterclockwise in FIG. 1 upon the shift of the cleaning unit 22 so as to bring the first porous member 222*b* into contact with the ink ejection surface 212. Alternatively, the cleaning liquid admitting slit 222*c* may be replaced with a plurality of through-holes.

The water roller 223 cleans with water the ink ejection surface 212 after being cleaned with the water-soluble organic solvent, which is arranged next to the cleaning liquid roller 222 along the shift direction of the casing 226. The length of the water roller 223 in the direction orthogonal to the paper surface in FIG. 3 is substantially the same as the transverse length of the ink ejection surface 212. The water roller 223 has a water roller rotary shaft 223*a* and a second porous member 223*b*. The water roller rotary shaft 223*a* is a cylindrical hollow shaft member and capable of containing therein water. The water roller rotary shaft 223*a* has a water admitting slit 223*c*, enabling the water therein to be supplied to the second porous member 223*b*. The water roller rotary shaft 223*a* is the member extending in the direction orthogonal to the paper surface, which is fixed to the casing 226 and connected to the water tank 223*d* shown in FIG. 4. The second porous member 223*b* is a porous member, such as a sponge, arranged around the water roller rotary shaft 223*a*, and is rotatable with respect to the water roller rotary shaft 223*a*. The second porous member 223*b* is arranged so that the uppermost position in the height position thereof is substantially the same as the height position of the upper tip end of the first blade member 221. The second porous member 223*b* rotates counterclockwise in FIG. 3 upon the shift of the cleaning unit 22 so as to bring the second porous member 223*b* into contact with the ink ejection surface 212.

Alternatively, the water admitting slit 223*c* may be replaced with a plurality of through-holes arranged at equal intervals.

The second blade member 224 wipes off liquid such as an ink, water and a cleaning liquid on the ink ejection surface 212, which is a plate-shaped member extending in one direction (a direction orthogonal to the paper surface in FIG. 3). The length of the second blade member 224 in the direction orthogonal to the paper surface is substantially the same as the transverse length of the ink ejection surface 212. The second blade member 224 is arranged at the rear end in the shift direction of the casing 226, and the upper tip end thereof is arranged at a slightly higher position than the ink ejection surface 212. The second blade member 224 is formed by an elastic deformable material, such as EPDM or fluoro rubber.

The restriction plate 225*a* is in contact with a part of the first porous member 222*b* of the cleaning liquid roller 222, and the restriction plate 225*b* is in contact with a part of the second porous member 22*eb* of the water roller 223. The first porous member 222*b* and the second porous member 223*b* are compressed upon contact with the restriction plates 225*a* and 225*b*, respectively. This enables the squeeze of the liquid absorbed by the first porous member 222*b* and the second porous member 223*b*. Thus, upon rotation of the first porous member 222*b* and the second porous member 223*b*, the parts of the first porous member 222*b* and the second porous member 223*b* which are in contact with the ink ejection surface 212 are shifted and brought into contact with the restriction plates 225*a* and 225*b*, so that the water and the cleaning liquid each containing the ink can be squeezed out of the first porous member 222*b* and the second porous member 223*b*, respectively. As shown in FIG. 1, the restriction plates 225*a* and 225*b* are columnar members having a trapezoidal cross section, and the upper area is smaller than the lower area.

The casing 226 supports the first blade member 221, the cleaning liquid roller 222, the water roller 223, the second blade member 224 and the restriction plates 225*a* and 225*b*, and has an arrangement section 226*a* to arrange the first blade member 221, the cleaning liquid roller 222 and the like, and an exhaust liquid storage section 226*b* to collect the exhaust liquid. The arrangement section 226*a* has a bottom surface 226*c*, a first blade member sidewall surface 226*d*, a second blade member sidewall surface 226*e*, a first sidewall 226*f* and a second sidewall 226*g*. The bottom surface 226*c* is a plate-shaped member underlying the first blade member 221, the second blade member 224, the cleaning liquid roller 222 and the water roller 223, and has holes h1 to h4 to permit passage of liquid arranged at positions corresponding to the first blade member 221, the cleaning liquid roller 222, the water roller 223 and the second blade member 224, respectively.

The first blade member sidewall surface 226*d* is arranged at the front in the shift direction of the first blade member 221, namely on the right in FIG. 3, and provided with a first fixing member 226*i* for fixing the first blade member 221. The upper height position of the first fixing member 226*i* is lower than the upper height position of the first blade member sidewall surface 226*d*, making it difficult for the ink wiped off by the first blade member 221 to overflow the casing 226. The second blade member sidewall surface 226*e* is arranged at the rear in the shift direction of the second blade member 224, namely on the left in FIG. 3, and provided with a second fixing member 226*j* for fixing the second blade member 224. The upper height position of the second fixing member 226*j* is lower than the upper height position of the second blade member sidewall surface 226*e*, making it difficult for the ink wiped off by the second blade member 224 to overflow the casing 226.

The first sidewall 226*f* is arranged so as to connect one end of the first blade member sidewall surface 226*d* and one end of the second blade member sidewall surface 226*e*, and provided with a hole to permit connection of a pipe for supplying the cleaning liquid from the cleaning liquid tank 222*d* to the cleaning liquid roller 222, and a hole to permit connection of a pipe for supplying the water from the water tank 223*d* to the water roller 223. The second sidewall 226*g* is opposed to the first sidewall 226*f*, and cooperates with the first sidewall 226*f* to support the water roller rotary shaft 223*a* and the cleaning liquid roller rotary shaft 222*a*. The exhaust liquid storage section 226*b* underlies the arrangement section 226*a* and temporarily stores the water, the ink, the cleaning liquid and the like after passing through the holes h1 to h4 arranged at the bottom surface 216*c*. The exhaust liquid storage section 226*b* is connected to the exhaust ink tank 226*k*. The water tank 223*d*, the cleaning liquid tank 222*d* and the exhaust ink tank 226*k* are detachably mounted on the surface of a later-described shift support member 85 opposite the cleaning unit 22.

Figure 5:
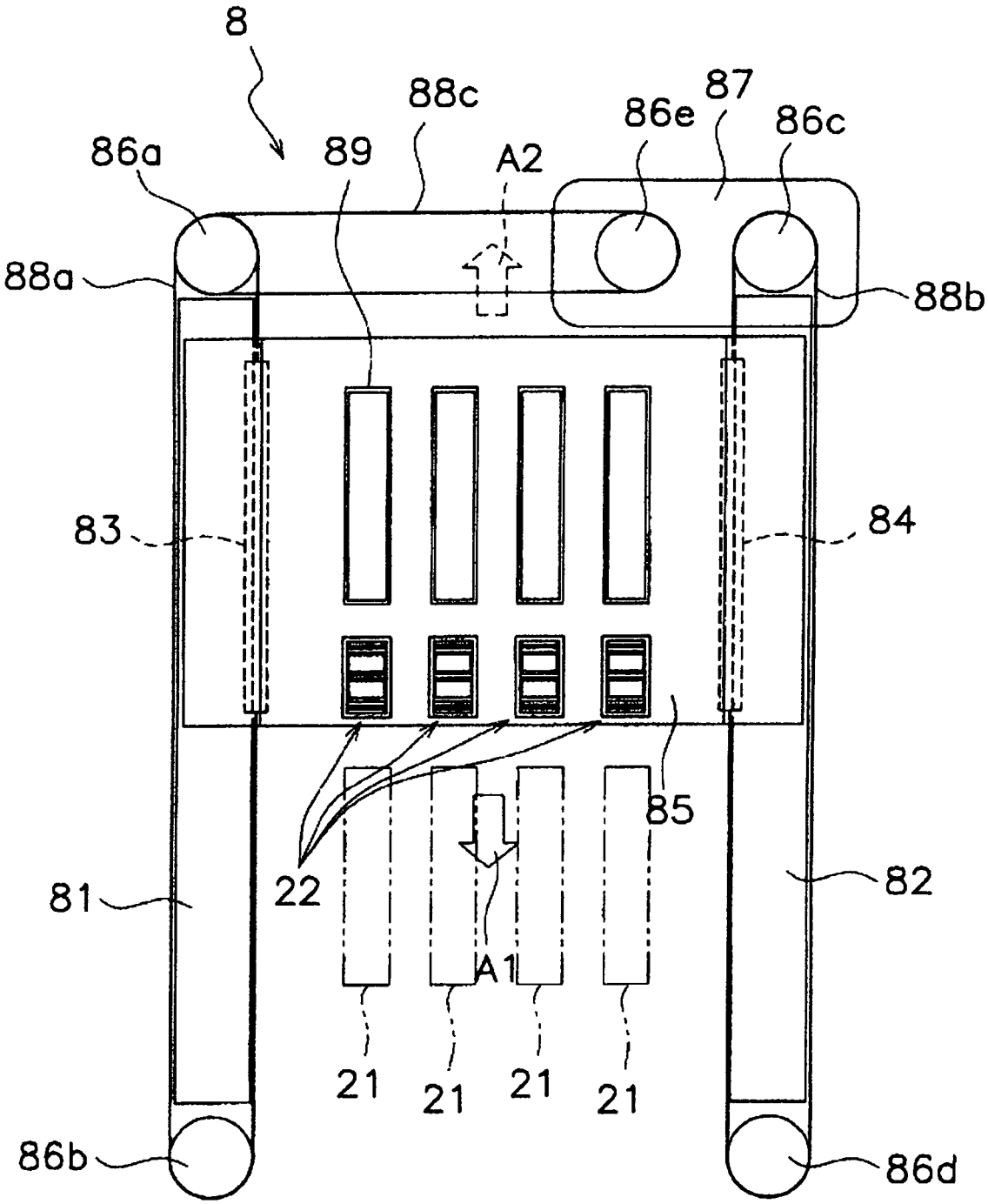
FIG. 5 is a diagram showing the configuration of the shift mechanism of the cleaning unit.

The shift mechanism 8 shown in FIG. 5 shifts the cleaning unit 22 in the longitudinal direction of the inkjet heads 21.

FIG. 5 is a schematic plan view schematically showing the configuration of the shift mechanism 8. The shift mechanism 8 is provided with a pair of rail members 81 and 82, a pair of sliders 83 and 84, the shift support member 85, a plurality of pulleys 86*a* to 86*e*, a drive motor 87 and a frame body (not shown) to support these members. The pair of the rail members 81 and 82 have a slender shape extending back and forth, and are spaced laterally and arranged parallel to each other. The pair of the sliders 83 and 84 are slidably provided along the rail members 81 and 82, respectively.

The shift support member 85 is formed by bending a plate material, and extends between the pair of the rail members 81 and 82. The shift support member 85 is fixed to the pair of the sliders 83 and 84, and shifts back and forth (in the direction indicated by the arrow A1 or A2) by the sliders 83 and 84 that shift along the rail members 81 and 82. A plurality of the cleaning units 22 are fixed to the front portion of the upper surface of the shift support member 85. A plurality of cap members 89 corresponding to the ink ejection surfaces 212 of the inkjet heads 21 are provided at the rear of the cleaning unit 22. In FIG. 5, the reference numeral is applied only one of these cap members 89, with others omitted. In the standby state, these cap members 89 cover the ink ejection surfaces 212, thereby preventing the ink from being dried and deteriorated.

Specifically, the plurality of pulleys 86*a* to 86*e* are the first pulley 86*a* to the fifth pulley 86*e*, each of which is provided rotatably. The first pulley 86*a* and the second pulley 86*b* are arranged on the front and the rear of the rail member 81 with the rail member 81 interposed therebetween, respectively. A belt 88*a*, one end of which is fixed to the front end of the slider 83 and the other end is fixed to the rear end of the slider 83, is entrained around the first pulley 86*a* and the second pulley 86*b*. The third pulley 86*c* and the fourth pulley 86*d* are arranged on the front and the rear of the rail member 82 with the rail member 82 interposed therebetween, respectively. A belt 88*b*, one end of which is fixed to the front end of the slider 84 and the other end is fixed to the rear end of the slider 84, is entrained around the third pulley 86*c* and the fourth pulley 86*d*. The third pulley 86*c* is rotationally driven by the drive motor 87. The fifth pulley 86*e* rotates in the opposite direction to the third pulley 86*c* upon the rotation transmission from the drive motor 87 through a gear (not shown) rotationally driven by the drive motor 87. An endless belt 88*c* is entrained around the fifth pulley 86*e* and the first pulley 86*a*.

In the shift mechanism 8, when the third pulley 86*c* is rotationally driven counterclockwise in FIG. 5 by the drive motor 87, the belt 88*b* is driven and the slider 84 is shifted forward. At the same time, the fifth pulley 86*e* is driven clockwise, so that the endless belt 88*c* and the belt 88*a* are driven and the slider 83 is shifted forward. Thus, the cleaning unit 22 shifts forward together with the shift support member 85 (refer to the arrow A1). When the drive motor 87 is driven in a direction opposite to the above-mentioned direction, the shift support member 85 and the cleaning unit 22 shift rearward (refer to the arrow A2).

<Ink>

Any one of conventionally used inkjet printer inks is applicable to the inkjet printer 1. These inks are composed mainly of a coloring agent (mostly a pigment), a resin and a solvent, and also contain various types of additives such as dehydrating agent and antioxidant when necessary. Although no limit is imposed on the resin, there are, for example, polymers and copolymers such as polystyrene, acryl resin, polyester, polyethylene and polyamide, low molecular weight polyethylene and polypropylene. The solubility parameter (hereinafter referred to as an "SP value") of these resins is normally in the range of 7 to 14, without being limited thereto. In general, 1 to 20% by weight of a resin is contained with respect to the total amount of an ink.

Usually, water alone or an aqueous medium obtained by adding an aqueous organic solvent into water is used as a solvent. Alternatively, surfactant, antiseptic and fungicide may be contained in the ink.

<Water-Soluble Organic Solvent>

The water-soluble organic solvent used as a cleaning liquid is preferably compatible with a resin. Examples thereof include alcohols such as ethanol, isopropyl alcohol, n-hexanol, 1,3-butandiol, hexylene glycol, ethylene glycol, triethylene glycol monobutyl ether, 2-pyrrolidone and glycerin, and ethers.

It is particularly preferable to use a water-soluble organic solvent having an SP value that approximates the SP value of the resin contained in an ink, in order to dissolve the solidified resin. Specifically, because the resin having an SP value of 7 to 14 is generally used in an ink, the SP value of the water-soluble organic solvent is preferably not more than 14, more preferably not more than 12. Further, the water-soluble organic solvent having a smaller SP value difference from the resin exhibits better dissolution. Therefore, the SP value difference between the resin and the water-soluble organic solvent is preferably not exceeding 0.5. Examples of suitable water-soluble organic solvents include ethanol (12.4), isopropyl alcohol (11.0), n-hexanol (10.2), 1,3-butandiol (13.9), hexylene glycol (11.8), triethylene glycol monobutyl ether (8.5) and 2-pyrrolidone (13.8), where the values in parentheses are the SP values of these organic solvents, respectively.

The use of the cleaning agent, namely, the above water-soluble organic solvents enables the removal of the resin composition of the ink adhering to the ink ejection sections 211 of the inkjet heads 21, thereby improving poor ink ejection.

<Cleaning Method>

When each of the ink ejection sections 211 of the inkjet heads 21 is cleaned, the cleaning unit 22 shifts in the longitudinal direction of the ink ejection surface 212 by the shift mechanism 8, from the state where the first blade member 221 is in contact with one end of the longitudinal direction of the ink ejection surface 212. Before starting a cleaning operation, the cleaning unit 22 is retracted rearwardly of the inkjet head 21 (refer to FIG. 5), and shifts forward upon starting the cleaning operation. Thus, the casing 226 is shifted to the other end in the longitudinal direction of the ink ejection surface 212. This shift brings the first blade member 221, the cleaning liquid roller 222, the water roller 223, the second blade member 224 into contact with the ink ejection section 211 in the order named.

At this time, the first blade member 221 wipes off the ink at the ink ejection section 211 (the ink wiping step). The ink wiped off by the first blade member 221 is admitted into the exhaust liquid storage section 226*b* through the hole h1, and then recovered into the exhaust ink tank 226 through the pipe.

Subsequently, the cleaning roller 222 slidingly contacts the portion from which the ink has been wiped off by the first blade member 221, and this portion is then cleaned with the water-soluble organic solvent (the first cleaning step). The cleaning liquid is supplied from the cleaning liquid tank 226*k* through the pipe, the hollow portion of the cleaning liquid roller rotary shaft 222*a* and the cleaning liquid admitting slit 222*c* to the cleaning roller 222. The portion of the second porous member 222*b* of the cleaning roller 222 which is brought into contact with the ink ejection surface 212 causes a rotational shift to contact the restriction plate 225*a*, so that the cleaning liquid containing the ink recovered from the ink ejection surface 212 can be squeezed from the first porous member 222*b*. The squeezed cleaning liquid is admitted into the exhaust liquid storage section 226*b* through the hole h2, and then recovered into the exhaust ink tank 226*k* through the pipe.

Next, the water roller 223 slidingly contacts the portion cleaned with the water-soluble organic solvent (the cleaning liquid), and this portion is then cleaned with water (the second cleaning step). The water is supplied from the water tank 223*d* through the pipe, the hollow portion of the water roller rotary shaft 222*a* and the water admitting slit 223*c* to the water roller 223. The portion of the second porous member 223*b* of the water roller 223 which is brought into contact with the ink ejection surface 212 causes a rotational shift to contact the restriction plate 225*b*, so that the water containing the ink recovered from the ink ejection surface 212 can be squeezed from the second porous member 223*b*. The squeezed cleaning liquid is admitted into the exhaust liquid storage section 226*b* through the hole h3, and then recovered into the exhaust ink tank 226*k* through the pipe.

Thereafter, the second blade member 224 wipes off the ink, the cleaning liquid and the water on the ink ejection surface 212 of the ink ejection section 211 (the liquid wiping step). The liquid thus wiped off by the second blade member 224 is admitted into the exhaust liquid storage section 226*b* through the hole h4, and then recovered into the exhaust ink tank 226*k* through the pipe.

Second Preferred Embodiment

A second preferred embodiment of the invention will be described below and, in some cases, the description of the identical parts to those of the first preferred embodiment will be omitted.

Figure 6:
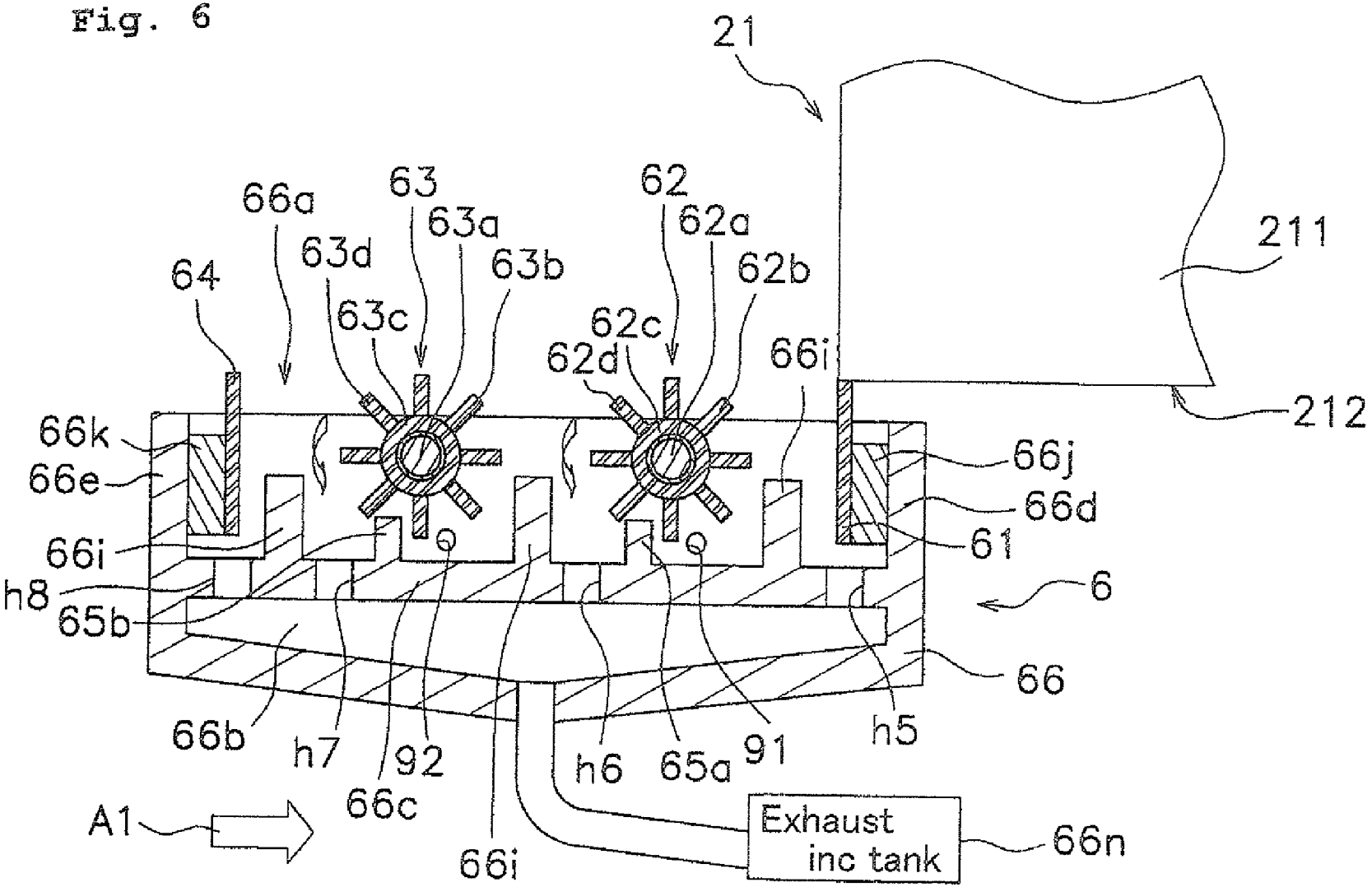
FIG. 6 is a sectional view of a cleaning unit according to a second preferred embodiment of the invention.
Figure 7:
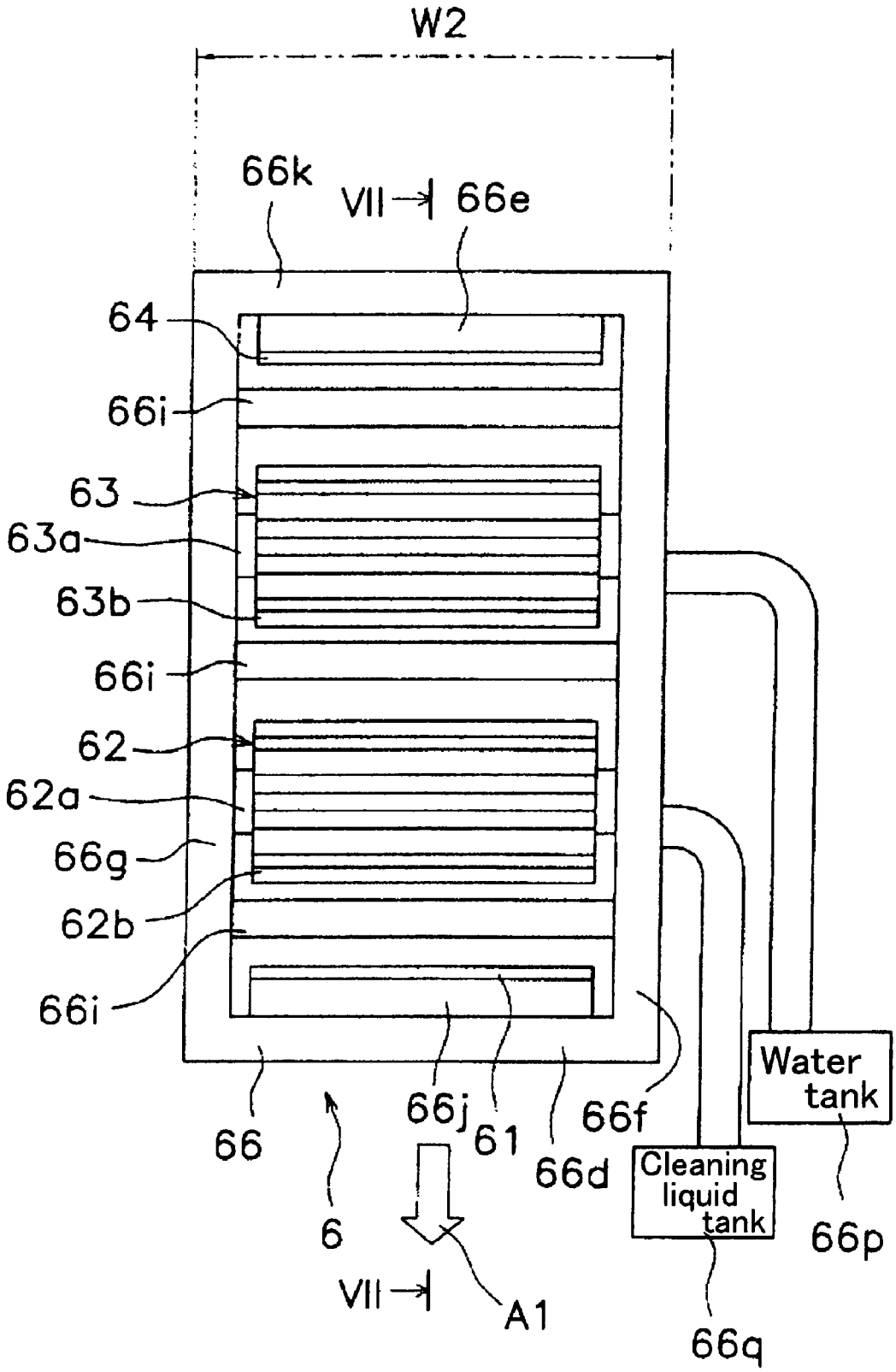
FIG. 7 is a plan view of the cleaning unit in FIG. 6.

FIGS. 6 and 7 are overall schematic diagrams of a cleaning unit according to the second preferred embodiment (hereinafter referred to as "second cleaning units 6"). FIG. 6 is a sectional view of each of the second cleaning units 6, and FIG. 7 is a plan view thereof.

Each of the second cleaning units 6 cleans an ink ejection surface 212, and the width W2 of the second cleaning unit 6, namely the length in a direction perpendicular to the paper surface in FIG. 6 (refer to FIG. 7) is larger than the width in the transverse direction of the ink ejection surface 212. These second cleaning units 6 are provided correspondingly to individual inkjet heads 21, and are connected to an exhaust ink tank 66*n*. The second cleaning units 6 are shifted in the direction of an arrow A1 in FIG. 5 along the ink ejection surfaces 212 by the same shift mechanism as the first preferred embodiment. Each of the second cleaning units 6 is provided with a third blade member 61, a first elastic gear 62, a second elastic gear 63, a fourth blade member 64, restriction plates 65*a* and 65*b*, and a second casing 66.

The third blade member 61 is a plate-shaped member for wiping off the ink on the ink ejection surface 212, and extends in one direction (a direction orthogonal to the paper surface). The length of the third blade member 61 in the direction orthogonal to the paper surface is substantially the same as the transverse length of the ink ejection surface 212. The third blade member 61 is arranged at one end of the second casing 66, and the upper tip end thereof is arranged at a slightly higher position than the ink ejection surface 212. The third blade member 61 is formed by an elastic deformable material, such as EPDM or fluoro rubber.

The first elastic gear 62 cleans the ink ejection surface 212 with a water-soluble organic solvent, and is arranged next to the third blade member 61 along the shift direction A1 of the second casing 66. The length of the first elastic gear 62 in a direction orthogonal to the paper surface is substantially the same as the transverse length of the ink ejection surface 212. The first elastic gear 62 also has a first rotary shaft 62*a* and a first elastic body member 62*b*. The first rotary shaft 62*a* extends in a direction orthogonal to the paper surface in FIG. 6, and is fixed to the second casing 66. The first elastic body member 62*b* has a tubular part 62*c* arranged around the first rotary shaft 62*a*, and blade parts 62*d* arranged radially from the tubular part 62*c*. At least the surface portions of the blade parts 62*d* are composed of a porous material, such as a sponge, and thus capable of absorbing a cleaning liquid. The first elastic body member 62*b* is arranged so that the uppermost position in the height position thereof is substantially the same as the height position of the upper tip end of the third blade member 61. The first elastic body member 62*b* is rotatable with respect to the first rotary shaft 62*a*, and rotates counterclockwise upon the shift of the second cleaning unit 6 so as to bring the blade parts 62*d* into contact with the ink ejection surface 212.

The second elastic gear 63 cleans the ink ejection surface 212 with water, and is arranged next to the first elastic gear 62 along the shift direction A1 of the second casing 66. The length of the second elastic gear 63 in a direction orthogonal to the paper surface is substantially the same as the transverse length of the ink ejection surface 212. The second elastic gear 63 has a second rotary shaft 63*a* and a second elastic body member 63*b*. The second rotary shaft 63*a* extends in a direction orthogonal to the paper surface and is fixed to the second casing 66. The second elastic body member 63*b* has a tubular part 63*c* arranged around the second rotary shaft 63*a*, and blade parts 63*d* arranged radially from the tubular part 63*c*. These blade parts 63 are provided with a porous material such as a sponge, and thus capable of absorbing water. The second elastic body member 63*b* is arranged so that the uppermost position in the height position thereof is substantially the same as the height position of the upper tip end of the fourth blade member 64. The second elastic body member 63*b* is rotatable with respect to the second rotary shaft 63*a*, and rotates counterclockwise upon the shift of the second cleaning unit 6 so as to bring the blade parts 63*d* into contact with the ink ejection surface 212.

The fourth blade member 64 wipes off the liquid, such as an ink, water and a cleaning liquid, on the ink ejection surface 212, which is a plate-shaped member extending in one direction (a direction orthogonal to the paper surface in FIG. 6). The fourth blade member 64 is arranged at the side end opposite the side end at which the third blade member 61 of the second casing 66 is arranged, and the upper tip end thereof is arranged at a slightly higher position than the ink ejection surface 212. The fourth blade member 64 is formed by an elastic deformable material, such as EPDM or fluoro rubber.

The restriction plates 65*a* and 65*b* are plate-shaped members projecting upward from a bottom surface 66*c* of the second casing 66, and arranged so as to contact the blade parts 62*d* and 63*d* of the first and second elastic gears 62 and 63, respectively. At the time of rotation of the first elastic gear 62 and the second elastic gear 63, the restriction plates 65*a* and 65*b* contact the blade parts 62*d* and 63*d*, and also press the blade parts 62*d* and 63*d*, thereby enabling the squeeze of the ink, the water and the cleaning liquid absorbed by the blade parts 62*d* and 63*d*.

The second casing 66 supports the third blade member 61, the first elastic gear 62, the second elastic gear 63, the fourth blade member 64 and the restriction plates 65*a* and 65*b*, and has an arrangement section 66*a* to arrange the third blade member 61, the first elastic gear 62 and the like, and an exhaust liquid storage section 66*b* to collect the exhaust liquid. The arrangement section 66*a* has the bottom surface 66*c*, a third blade member sidewall surface 66*d*, a fourth blade member sidewall surface 66*e*, a first sidewall 66*f* and a second sidewall 66*g*.

The bottom surface 66*c* is a plate-shaped member underlying the third and fourth bade members 61 and 64, and the first and second elastic gears 62 and 63, and has holes h5 to h8 to permit passage of liquid arranged at positions corresponding to the third blade member 61, the first elastic gear 62, the second elastic gear 63 and the fourth blade member 64, respectively. The bottom surface 66*c* is further provided with partition projections 66*i* to partition the space for the third blade member 61, the space for the first elastic gear 62, the space for the second elastic gear 63, and the space for the fourth blade member 64.

The third blade member sidewall surface 66*d* is arranged at the front in the shift direction of the third blade member 61, namely on the right in FIG. 6, and provided with a third fixing member 66*j* for fixing the third blade member 61. The upper height position of the third fixing member 66*j* is lower than the upper height position of the third blade member sidewall surface 66*d*, making it difficult for the ink wiped off by the third blade member 61 to overflow the second casing 66. The fourth blade member sidewall surface 66*e* is arranged at the rear in the shift direction of the fourth blade member 64, namely on the left in FIG. 6, and provided with a fourth fixing member 66*k* for fixing the fourth blade member 64. The upper height position of the fourth fixing member 66*k* is lower than the upper height position of the fourth blade member sidewall surface 66*e*, making it difficult for the ink wiped off by the fourth blade member 64 to overflow the second casing 66.

The first sidewall 66*f* is arranged so as to connect one end of the third blade member sidewall surface 66*d* and one end of the fourth blade member sidewall surface 66*e*, and provided with a hole 91 to permit connection of a pipe for supplying the water-soluble organic solvent from a cleaning liquid tank 66*q* to the first elastic gear 62, and a hole 92 to permit connection of a pipe for supplying water from a water tank 66*p* to the second elastic gear 63. The second sidewall 66*g* is opposed to the first sidewall 66*f*, and cooperates with the first sidewall 66*f* to support the first and second elastic gears 62 and 63. The exhaust liquid storage section 66*b* underlies the arrangement section 66*a*, and temporarily stores the water, the ink, the cleaning liquid and the like after passing through the holes h5 to h8 provided at the bottom surface 66*c*. The exhaust storage section 66*b* is connected to the exhaust ink tank 66*n*.

<Cleaning Method>

When each of the ink ejection sections 211 of the inkjet heads 21 is cleaned, the second casing 66 is shifted in the direction indicated by the arrow A1 from the state in which the third blade member 61 is in contact with one end of the longitudinal direction of the ink ejection section 211, to the other end in the longitudinal direction of the ink ejection section 211. This shift brings the third blade member 61, the first elastic gear 62, the second elastic gear 63 and the fourth blade member 64 into contact with the ink ejection section 211 in the order named.

At this time, the third blade member 61 wipes off the ink at the ink ejection section 211 (the ink wiping step). The ink wiped off by the third blade member 61 is admitted into the exhaust liquid storage section 66*b* through the hole h5, and then recovered into the exhaust ink tank 66*n* through the pipe.

Subsequently, the first elastic gear 62 slidingly contacts the portion from which the ink has been wiped off by the third blade member 61, and this portion is then cleaned with the water-soluble organic solvent (the first cleaning step). Hereat, the cleaning liquid supplied from the hole 91 is absorbed by the first elastic gear 62, and the portion of the first elastic gear 62 containing the cleaning liquid causes a rotational shift and contacts the ink ejection surface 212, thereby cleaning the ink ejection surface 212. Upon a further rotation of the first elastic gear 62 so as to contact the restriction plate 65*a*, the water-soluble organic solvent that contains the ink by cleaning the ink ejection surface 212 is squeezed from the first elastic gear 62 and admitted into the exhaust liquid storage section 66*b* through the hole h6, and then recovered into the exhaust ink tank 66*n* through the pipe. The water-soluble organic solvent excessively supplied from the hole 91 is also exhausted from the hole h6. In order to reduce a waste of the water-soluble organic solvent, a sensor to detect the liquid surface level of the stored water-soluble organic solvent may be provided to control the supply amount of the water-soluble organic solvent based on the liquid surface level detected by the sensor.

Next, the second elastic gear 63 slidingly contacts the portion cleaned with the water-soluble organic solvent, and this portion is then cleaned with water (the second cleaning step). Hereat, the water supplied from the hole 92 is absorbed by the second elastic gear 63, and the portion of the second elastic gear 63 containing water causes a rotational shift and contacts the ink ejection surface 212, thereby cleaning the ink ejection surface 212. Upon a further rotation of the second elastic gear 63 so as to contact the restriction plate 65*b*, the water that contains the ink by cleaning the ink ejection surface 212 is squeezed from the second elastic gear 63 and admitted into the exhaust liquid storage section 66*b* through the hole h7, and then recovered into the exhaust ink tank 66*n* through the pipe. The water excessively supplied from the hole 92 is also exhausted from the hole h7. In order to reduce a waste of water, a sensor to detect the water level of the stored water may be provided to control the supply amount of water based on the water level detected by the sensor.

Thereafter, the fourth blade member 64 wipes off the ink, the cleaning liquid and the water on the ink ejection surface 212 of the ink ejection section 211 (the liquid wiping step). The liquid thus wiped off by the fourth blade member 64 is discharged through the hole h8. Otherwise, the cleaning method is identical to that of the first preferred embodiment, and therefore the description thereof is omitted here.

Other Preferred Embodiments

The shift mechanism for shifting the cleaning units are not limited to those of the foregoing preferred embodiments, and a different mechanism may be employed. Alternatively, the cleaning units may be fixed, and a shift mechanism for shifting the inkjet heads may be employed.

In the foregoing preferred embodiments, the cleaning units are applied to the image forming apparatus that forms an image on a paper. Alternatively, the cleaning units may be applied to an image forming apparatus that forms an image on an image formation object other than papers.

Examples of the present invention will be described below. It is understood, however, that the examples are for the purpose of illustration and the invention is not to be regarded as limited to any of the specific materials or condition therein.

EXAMPLES

Example 1

<Preparation of Pigment Dispersion Liquid>

A pigment dispersion liquid was prepared by mixing 30% by weight of C.I. pigment red 122 as a pigment, 30% by weight of styrene-acrylic resin ("JONCRYL61" manufactured by Johnson Polymer Corporation), 10% by weight of glycerin and 35% by weight of an ion exchanged water, and dispersing this mixture with 0.5 mm zirconia beads by using a ball mill until the mean particle size became 100 nm. The SP value of the used styrene-acrylic resin was 8 to 12. The mean particle size was measured by a dynamic light scattering particle size distribution measuring apparatus ("LB-550" manufactured by HORIBA Ltd.) after the pigment dispersion liquid was diluted five times with the ion exchanged water.

<Preparation of Ink>

An ink was prepared by mixing 0.5% by weight of ethylene oxide addition product of acetylene diol as being surfactant ("Olfine E1010" manufactured by Nisshin Chemical Industry Co., Ltd.), 5% by weight of triethylene glycol monobuthyl ether, 5% by weight of 2-pyroridone, 20% by weight of the above-mentioned pigment dispersion liquid and 69.5% by weight of water, and sufficiently stirring the mixture, followed by filtering with a filter having a hole diameter of 5 μm.

<Cleaning>

Under the environment of 25° C. and 50% RH, the ink ejection surfaces of the inkjet heads filled with the ink were exposed to the air and left for a week. Thereafter, the cleaning of the ink ejection surfaces was carried out by the cleaning method of the first preferred embodiment by using triethylene glycol monobuthyl ether (8.5 in SP value) as a water-soluble organic solvent. After cleaning, the ink ejection surfaces were pressed and purged, and recleaned by the same method as the above cleaning method.

Example 2

Cleaning was carried out in the same manner as in Example 1, except that instead of triethylene glycol monobuthyl ether, 2-pyroridone (13.8 in SP value) was used as a cleaning agent.

Example 3

Cleaning was carried out in the same manner as in Example 1, except that instead of triethylene glycol monobuthyl ether, glycerin (18.1 in SP value) was used as a cleaning agent.

Examples 4 and 5

An ink was prepared in the same manner as in Example 1, except that a pigment dispersion liquid was prepared by mixing 30% by weight of C.I. pigment red 122 as a pigment, 30% by weight of acrylic resin ("Acrylpolymer T540" manufactured by To a Gosei Kagaku Co., Ltd.), 10% by weight of glycerin and 35% by weight of an ion exchanged water. Subsequently, cleaning was carried out in the same manner as in Example 1, except that triethylene glycol monobuthyl ether and 2-pyroridone were used as a water-soluble organic solvent for cleaning. The SP value of the used acrylic resin was 8 to 12.

Example 6

Cleaning was carried out in the same manner as in Example 4 or 5, except that glycerin (18.1 in SP value) was used as a cleaning agent.

Comparative Example 1

Cleaning was carried out in the same manner as in Example 1, except that water (23.4 in SP value) was used as a cleaning liquid.

Comparative Example 2

Cleaning was carried out in the same manner as in Example 4 or 5, except that water (23.4 in SP value) was used as a cleaning liquid.

<Evaluation Test and Evaluation Method>

After the cleaning was terminated, the non-ejection of the ink was confirmed by printing a 1 (one)-dot and 1 (one)-space vertical line on a glazed paper under the conditions that the drive frequency of the inkjet heads was 20 kHz, the distance between the nozzle ejection surface and a recording medium was 1.0 mm, and the transfer speed of the recording medium was 847 mm/sec. Further, the line width was measured to confirm whether the line width error was less than ±20 μm. Table 1 shows these results.

TABLE 1

| | Water-soluble organic solvent | Resin used for pigment dispersion liquid | SP value of water-soluble organic solvent | Evaluation results |
|---|---|---|---|---|
| Example 1 | Triethylene glycol monobuthyl ether | JONCRYL61 | 8.5 | ◎ |
| Example 2 | 2-pyroridone | JONCRYL61 | 13.8 | ○ |
| Example 3 | glycerin | JONCRYL61 | 18.12 | Δ |
| Example 4 | Triethylene glycol monobuthyl ether | Acrylpolymer T540 | 8.5 | ◎ |
| Example 5 | 2-pyroridone | Acrylpolymer T540 | 13.8 | ○ |
| Example 6 | glycerin | Acrylpolymer T540 | 18.12 | Δ |

TABLE 1-continued

| | Water-soluble organic solvent | Resin used for pigment dispersion liquid | SP value of water-soluble organic solvent | Evaluation results |
|---|---|---|---|---|
| Comparative Example 1 | water | JONCRYL61 | 23.4 | X |
| Comparative Example 2 | water | Acrylpolymer T540 | 23.4 | X |

"◎" denotes the absence of the non-ejection and the line width error of less than ±20 μm.
"○" denotes the absence of the non-ejection and the line width error of not less than ±20 μm.
"Δ" denotes a slight non-ejection at such a level as not to cause any problem, and the line width error of not less than ±20 μm.
"X" denotes the presence of the non-ejection.

As shown in Table 1, both Comparative Example 1 and Comparative Example 2 caused the non-ejection of the ink. On the other hand, none of Examples 1 to 4 caused the non-ejection of the ink.

What is claimed is:

1. A method of cleaning an ink ejection section in an image forming apparatus that forms an image by ejecting an ink from the ink ejection section, comprising the steps of:

an ink wiping step for wiping off the ink on a surface of the ink ejection section;

a first cleaning step for cleaning the surface of the ink ejection section with a water-soluble organic solvent;

a second cleaning step for cleaning with water the surface of the ink ejection section cleaned with the water-soluble organic solvent; and a liquid wiping step for wiping off the liquid on the surface of the ink ejection section cleaned through the second cleaning step.

2. The method of cleaning an ink ejection section according to claim 1, wherein the water-soluble organic solvent has a solubility parameter (SP value) of 7 to 14.

3. The method of cleaning an ink ejection section according to claim 1, wherein the ink contains a coloring agent, a resin and a solvent, and the resin has a solubility parameter (SP value) of 7 to 14.

4. The method of cleaning an ink ejection section according to claim 3, wherein the SP value difference between the resin and the water-soluble organic solvent is not exceeding 0.5.

5. The method of cleaning an ink ejection section according to claim 1, wherein the first cleaning step is carried out by using a porous member impregnated with a water-soluble organic solvent.

6. The method of cleaning an ink ejection section according to claim 5, wherein the ink ejection section is cleaned with the water-soluble organic solvent by shifting the porous member impregnated with the water-soluble organic solvent while bringing it into contact with the ink ejection section.

7. The method of cleaning an ink ejection section according to claim 1, wherein the second cleaning step is carried out by using a porous member impregnated with water.

8. The method of cleaning an ink ejection section according to claim 7, wherein the ink ejection section is cleaned with water by shifting the porous member impregnated with water while bringing it into contact with the ink ejection section.

9. The method of cleaning an ink ejection section according to claim 1, wherein the ink wiping step is carried out by using a blade member shifting the surface of the ink ejection section.

10. The method of cleaning an ink ejection section according to claim 1, wherein the liquid wiping step is carried out by using a blade member shifting the surface of the ink ejection section.

11. A cleaning unit of an ink ejection section shiftably mounted in an image forming apparatus provided with an ink ejection section having an ink ejection surface capable of ejecting an ink, the cleaning unit comprising:

a first blade member for wiping off ink contactable with the ink ejection surface;

a first porous member impregnated with a water-soluble organic solvent;

a second porous member impregnated with water; and a second blade member for wiping off liquid contactable with the ink ejection surface, wherein the first blade member, the first porous member, the second porous member and the second blade member are arranged in the order named along the shift direction of the cleaning unit.

12. The cleaning unit of an ink ejection section according to claim 11, wherein the first blade member, the first porous member, the second porous member and the second blade member are supported by a housing.

13. The cleaning unit of an ink ejection section according to claim 11, wherein the first porous member is arranged on at least either of a surface of a roller or a surface of blade parts extending radially from a tubular part of an elastic gear.

14. The cleaning unit of an ink ejection section according to claim 11, wherein the second porous member is arranged on at least either of a surface of a roller or a surface of blade parts extending radially from a tubular part of an elastic gear.

15. An image forming apparatus comprising an image formation section provided with an ink ejection section having an ink ejection surface capable of ejecting an ink, and the cleaning unit according to claim 11.

* * * * *